US005975070A

United States Patent [19]

Sands

[11] Patent Number: 5,975,070

[45] Date of Patent: Nov. 2, 1999

[54] BOW STABILIZING DEVICE

[75] Inventor: William Lee Sands, 4301 Mountain Rd., Lake Shore Plz., Pasadena, Md. 21122

[73] Assignee: William Lee Sands, Pasadena, Md.

[21] Appl. No.: 09/181,130

[22] Filed: Oct. 28, 1998

[51] Int. Cl.[6] ..... F41B 5/20

[52] U.S. Cl. ..... 124/89; 267/136

[58] Field of Search ..... 124/89; 267/136, 267/137, 140.12, 141.2

[56] References Cited

U.S. PATENT DOCUMENTS

| | | | |
|---|---|---|---|
| 4,245,612 | 1/1981 | Finlay | 124/89 |
| 4,615,327 | 10/1986 | Saunders | 124/89 |
| 4,660,538 | 4/1987 | Burgard | 124/89 |
| 4,982,719 | 1/1991 | Haggard et al. | 124/89 |
| 5,339,793 | 8/1994 | Findley | 124/89 |
| 5,385,136 | 1/1995 | Thomas | 124/89 |
| 5,460,156 | 10/1995 | Sappington | 124/89 |
| 5,615,664 | 4/1997 | McDonald | 124/89 |

*Primary Examiner*—John A. Ricci

[57] ABSTRACT

A stabilizer for an archery bow includes an exterior tube, with end caps at each end, with a central shaft supported within the tube between the end caps, and projecting beyond an end cap for threaded attachment to the bow. Various piston weights and resilient dampening elements are provided and slidably mountable on the shaft within the tube; the number and sequence of weights and/or dampening elements may be selected to customize the stabilizer to a particular bow or the preference of the archer. The assembly of weights and/or dampening elements are held on the shaft between collars, which may be moved along the shaft to adjust the center of gravity of the stabilizer. The collars may be adjusted to apply compression against the assembly to adjust the vibration dampening characteristics.

12 Claims, 2 Drawing Sheets

BOW STABILIZING DEVICE

BACKGROUND OF THE INVENTION

The present invention relates to archery and more particularly a bow stabilizing device which in preferred embodiment is characterized by a cylindrical housing fitted with a pair of threaded end caps for disassembly and attaching the stabilizer in a threaded receptacle located in the bow handle. Internal piston or pistons move longitudinally at the release of the bow string and ejection of an arrow from the bow to dampen the vibrations and arrow forces. The present invention allows the user to internally adjust the relative center of gravity, with weights and buffers. Other types of bow stabilizers for increasing bow accuracy by reducing such detrimental actions as slapping, vibration, recoil hand torque and shooter fatigue, in nonexclusive particular, are well known in the art. Many of these devices are hydraulic in design, wherein a central piston-like member reciprocates in pool of hydraulic oil or other viscous fluid within a housing to effect the desired dampening of bow string and arrow release vibration and forces acting on the bow when an arrow is released from the bow. A disadvantage of many of these devices is excessive weight, coupled with a variation in effectiveness to use the desired dampening due to variations in temperature, which variation affects the viscosity of the fluid used as a dampening medium. These devices are not known for their silence. The present invention uses an energy absorbing medium that is not effected by temperature changes under normal conditions and also energy absorption upon arrow release from the bow string. Noise reduction is achieved with this device by use of the internal material's capacity to absorb the sound energy produced by the bow upon release of the string. This invention also shall provide the user with a multitude of custom adjustments to tune his bow to his own liking and shooting efficiency, another object of this invention is to provide a new and improved use on single and dual cam bows; due to the adjustability of the stabilizer it can be tuned for radical and soft shooting bows.

The use of bow stabilizers is known as prior art. More specifically, bow stabilizers are known to consist basically of familiar, expected and obvious structural configurations, notwithstanding the myriad of designs encompassed by the prior art which have been developed for the fulfillment of countless objectives and requirements in the archery field. By way of background U.S. Pat. No. 5,558,078 to Dunlap discloses a bow stabilizer. U.S. Pat. No. 5,339,793 to Findley discloses yet another bow stabilizer. U.S. Pat. No. 4,982,719 to Haggard discloses a hydraulic bow stabilizer. U.S. Pat. No. 4,615,327 to Saunders discloses a resiliently mounted stabilizer. And lastly U.S. Pat. No. 4,570,608 to Masterfield discloses an Archery Bow stabilizer and vibration dampener.

Although there are many examples of prior art this internally adjustable bow stabilizer differs from the conventional designs in that the Center Of Gravity, the Total Mass Weight and the efficiency of the energy buffer can be adjusted together or individually internally by disassembling the stabilizer and rearranging the internal components. Therefore it can be appreciated that there exists continuing need for improving the efficiency of a bow stabilizer, and this invention substantially fulfills this need. With existing stabilizers of this type no internal mass adjustments are capable, what you see is what you get.

BRIEF SUMMARY OF THE INVENTION

In view of the short comings of the existing bow stabilizers and disadvantages that are inherent to their designs, there is a need for an internally adjustable stabilizer, capable of fine tuning to a degree that makes a bow system a fine-tuned shooting machine.

To attain the adjustability needed to achieve this tunability the present stabilizer is able to change the "relative center of gravity" by first removing the caps thus exposing the internal assembly, by loosening and sliding the energy dampening medium, and weight assembly back and forth or moving a dampener from one end to the other end of the tube until perfect balance is achieved. Another feature is the ability to exchange the heavy weight for a lighter weight or combine the two with a dampening medium therebetween to dampen vibration and noise; this allows the archer custom tuning of the total mass of the stabilizer. By changing the compression on the combination of the weight with the dampening medium by adjusting the collar and washer tighter against the dampening medium, the stabilizer can be adjusted to absorb shock and noise at different rates for different bows. This amount of adjustability will help in relieving the shooter fatigue, string slapping and accessory noise caused by the vibrations of modern high speed bows. The dampening medium used in this invention is unaffected by temperature unlike some stabilizers using oil-like materials to dampen movement.

There has thus been outlined, rather broadly, the more important features of the invention in order that the detailed description thereof that follows may be better understood, and in order that the present contribution to the art may be better appreciated. It is therefore an objective of the present invention to provide a new and improved stabilizer to achieve more accuracy, and much improved vibration and noise reduction.

BRIEF DESCRIPTION OF THE DRAWINGS

The invention will be better understood by viewing the drawings accompanying this application wherein.

DETAILED DESCRIPTION OF THE INVENTION

Figure 1:
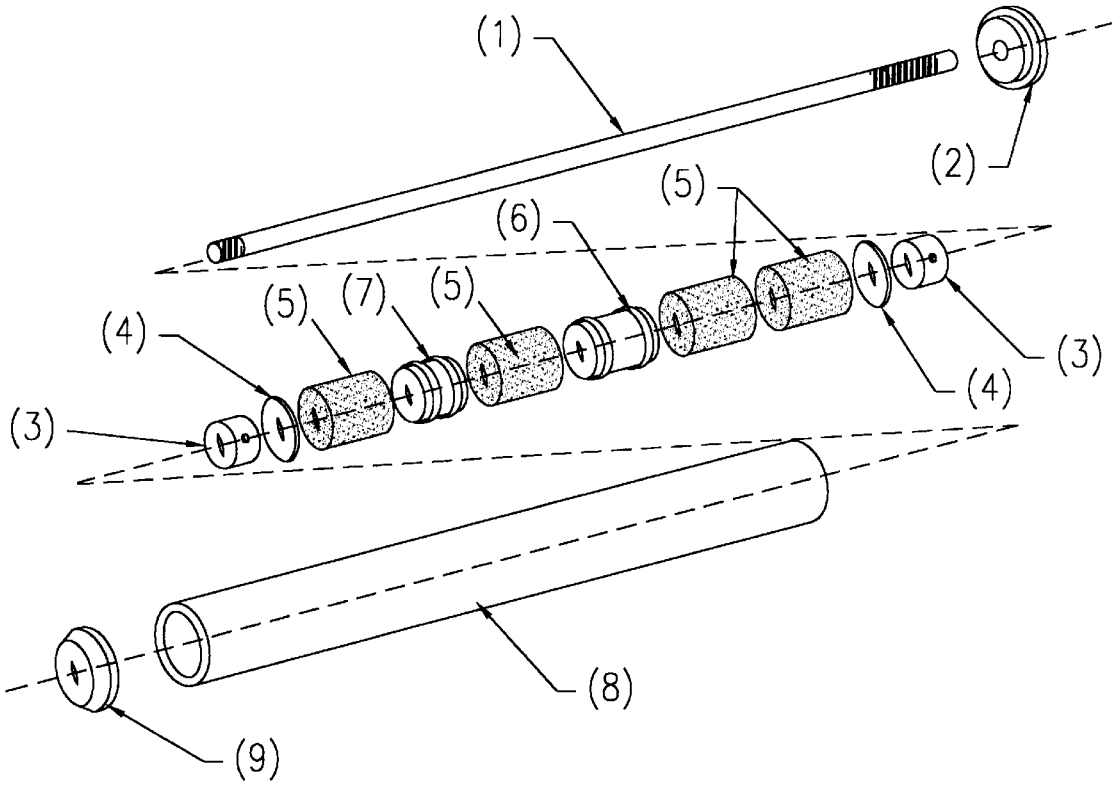
FIG. 1 is an exploded view of the entire stabilizer system with all components present.

The present invention relates to a device that balances, stabilizes, and suppresses bow noise. To attain the adjustability needed to achieve these features with the present stabilizer, it is possible to internally change the "relative center of gravity" by first removing the front or back end caps 2, 9, thus exposing the internal assembly, next by loosening the collars 3 with a hex wrench and sliding the energy dampening medium, 5 and weight assembly 6, 7 back and forth from one end of the cylinder to the other until perfect balance of the bow is achieved. Another feature is the capability to exchange the heavy weight 6 for the lighter weight 7 or combine the two with a dampening medium 5 therebetween, this procedure not only changes mass weight, but also changes the energy absorbing characteristics that dampen vibration and noise. This allows the archer the capability of custom tuning of the total mass of the stabilizer and to change the frequency (speed) of the dampening effect. This can be accomplished by changing the compression on the combination of the weight 6, 7 and the dampening medium 5. This is achieved by adjusting the collar 3 and washer 4 tighter against the dampening medium 5, this adjustment changes the distance the weight can move in response to the release of the bow's string. Thus the stabilizer can be adjusted to absorb shock and noise at different frequency for different bows.

Figure 2:
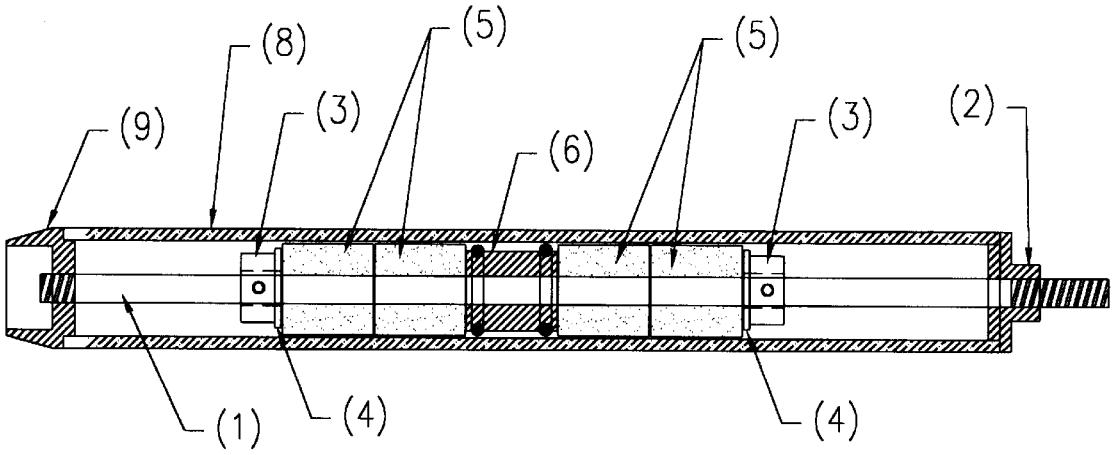
FIG. 2 is the assembled stabilizer showing just one of many configurations obtainable with entire stabilizer system.
Figure 3:
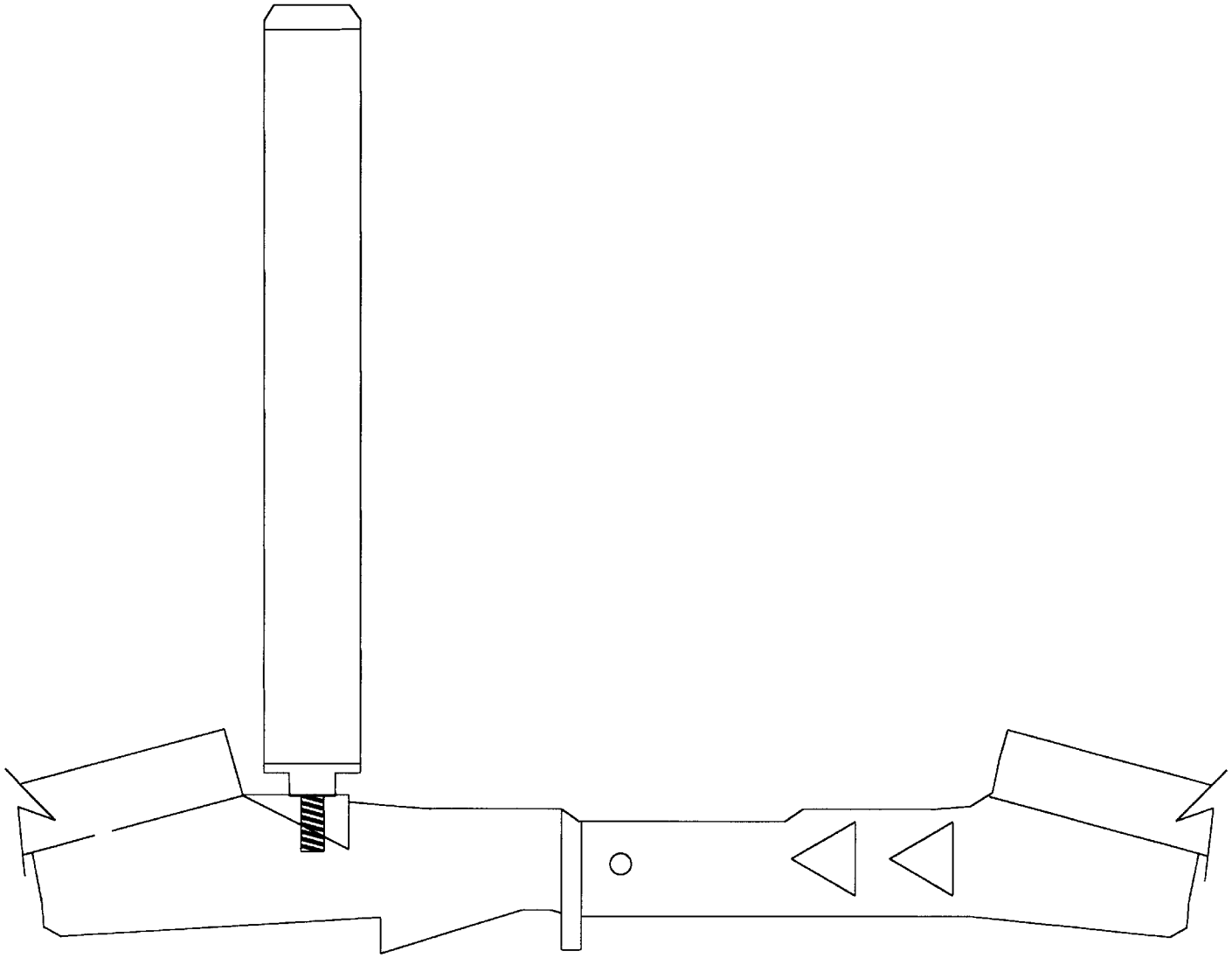
FIG. 3 reflects the stabilizer installed on a bow handle riser, the standard threaded location for such accessories.

The entire assembly is contained within an external cylindrical tube 8 with the internal components sliding on the inside surface of the exterior cylindrical tube. The mainshaft 1 is threaded at both ends with one end threaded through back end cap 2 and capable of mounting on a bow handle riser section at the attachment fitting (FIG. 3) common on modern bow's handles, while the other end is threaded into the front end cap 9 to hold the entire stabilizer together. Although many arrangements of this assembly can be derived with components supplied, FIG. 2 shows but just one possibility. This multitude of arrangements allow the archer to best suit his or her bow and shooting ability. This stabilizer works by the weight or weights 6, 7 moving, longitudinally inside the cylindrical tube, as the bow string is released. As the weights move, the dampening medium 5 restricts the movement and thusly absorbs the energies set forth by the releasing of the bow's string. The dampening action continues until all energy is dissipated. With the present device the effect can be controlled not only with added internal weights but also by compression upon these weights by moving the collars 3 and washers closer and tighter further restricting the movement of the piston weight 6, 7. This entire system can be located any longitudinal location desired within the exterior cylindrical tube which changes the center of gravity of the entire stabilizer, helping to aim and assisting in the accuracy of the bow.

What I claim as my invention is as follows:

1. A stabilizer attachable to an archery bow comprising:

an exterior tube;

end caps at each end of the exterior tube;

a main shaft connected between the end caps and supported within the tube;

means for absorbing vibration and noise slidably supported along the main shaft within the tube;

two collars slidably supported along the main shaft within the tube, one collar on each side of the means for absorbing vibration and noise;

means to loosen each collar for allowing sliding along the main shaft, and for locking each collar to the main shaft at a selected location;

whereby the means for absorbing vibration and noise is held in place along the main shaft between the two collars and the location of the means for absorbing vibration and noise may be adjusted by loosening the collars, sliding the collars and means for absorbing vibration and noise to a desired location, and locking the collars, thereby adjusting a balance point of the stabilizer.

2. The stabilizer of claim 1, further comprising means to attach the stabilizer to an archery bow.

3. The stabilizer of claim 2, wherein the means for attachment to an archery bow is a threaded shaft extending from an end cap.

4. The stabilizer of claim 3, wherein the threaded shaft is integral with the main shaft which extends through an end cap.

5. The stabilizer of claim 1, wherein the main shaft is threaded at each end and received in threaded holes in each end cap.

6. The stabilizer of claim 1, wherein the means for absorbing vibration and noise includes at least one piston weight.

7. The stabilizer of claim 6, wherein the means for absorbing vibration and noise includes at least two piston weights, each piston weight being of a different size or weight.

8. The stabilizer of claim 1, wherein the means for absorbing vibration and noise includes at least one resilient dampening element.

9. The stabilizer of claim 1, wherein the means for absorbing vibration and noise includes at least one piston weight in combination with at least one resilient dampening element, and a combination of piston weights and/or resilient dampening elements may be placed on the main shaft between the collars.

10. The stabilizer of claim 9, wherein the means for absorbing vibration and noise includes at least one resilient dampening element placed on the main shaft, and the collars are adjusted to apply a compression force against said resilient dampening element, thus adjusting a dampening quality of said resilient dampening element.

11. The stabilizer of claim 1, further including a washer between each collar and the means for absorbing vibration and noise.

12. A kit for building a stabilizer which may be attached to an archery bow, the kit comprising:

an exterior tube;

end caps for placement at each end of the exterior tube;

a main shaft for connection between the end caps for being supported within the tube;

at least one piston weight which may be slidably supported along the main shaft;

at least one resilient dampening element which may be slidably supported along the main shaft;

two collars for being slidably supported along the main shaft within the tube;

means to loosen each collar for allowing sliding along the main shaft, and for locking each collar to the main shaft at a selected location;

whereby a combination of piston weights and/or resilient dampening elements may be placed upon the main shaft and held in place along the main shaft between the two collars and the location of the combination of piston weights and/or resilient dampening elements may be adjusted by loosening the collars, sliding the collars and combination of piston weights and/or resilient dampening elements to a desired location, and locking the collars; and means for attaching the stabilizer to an archery bow.

* * * * *

UNITED STATES PATENT AND TRADEMARK OFFICE

CERTIFICATE OF CORRECTION

PATENT NO. : 5,975,070

DATED : NOV. 2, 1999

INVENTOR(S) : WILLIAM LEE SANDS

It is certified that error appears in the above-identified patent and that said Letters Patent is hereby corrected as shown below:

On title page, Item [75],
should read;

WILLIAM LEE SANDS
237 Carvel Rd.
Pasadena, MD 21122

Signed and Sealed this

Thirteenth Day of June, 2000

*Attest:*

Q. TODD DICKINSON

*Attesting Officer*

*Director of Patents and Trademarks*